US007205720B2

(12) United States Patent
Kim

(10) Patent No.: US 7,205,720 B2
(45) Date of Patent: Apr. 17, 2007

(54) PLASMA DISPLAY PANEL

(75) Inventor: Se-Jong Kim, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 11/295,534

(22) Filed: Dec. 7, 2005

(65) Prior Publication Data

US 2006/0119280 A1 Jun. 8, 2006

(30) Foreign Application Priority Data

Dec. 8, 2004 (KR) ..... 10-2004-0103131

(51) Int. Cl.
*H01J 17/49* (2006.01)

(52) U.S. Cl. ..... 313/582; 313/584; 313/609; 313/485; 313/581; 315/169.4; 345/60; 345/65

(58) Field of Classification Search ..... 313/482, 313/484, 485, 506, 509, 581–587, 609, 610; 315/169.1, 169.2, 169.4; 345/60, 65, 77; 445/24, 25

See application file for complete search history.

(56) References Cited

U.S. PATENT DOCUMENTS 5,541,618 A 7/1996 Shinoda
5,661,500 A 8/1997 Shinoda et al.
5,663,741 A 9/1997 Kanazawa
5,674,553 A 10/1997 Sinoda et al.
5,724,054 A 3/1998 Shinoda
5,786,794 A 7/1998 Kishi et al.
5,793,158 A * 8/1998 Wedding, Sr. ..... 313/493
5,952,782 A 9/1999 Nanto
6,184,849 B1 * 2/2001 Stoller ..... 345/72

(Continued)

FOREIGN PATENT DOCUMENTS

JP 2845183 10/1998

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Haissa Philogene
(74) *Attorney, Agent, or Firm*—Robert E. Bushnell, Esq.

(57) ABSTRACT

A plasma display panel (PDP) has a structure which extends a discharge space, increases a visible light emission area, enables a low driving voltage, and improves light emission efficiency. The PDP comprises: a pair of substrates including a first substrate and a second substrate facing each other; a barrier rib located between the first substrate and the second substrate, and defining discharge, together with the first and second substrates, cells where gas discharge is generated; a plurality of discharge electrodes comprising first discharge electrodes and second discharge electrodes, surrounding the discharge cell vertically spaced in the barrier rib, for generating a gas discharge by mutual actions; and a first phosphor layer and a second phosphor layer located in the discharge cell formed in the first substrate and in the discharge cell formed in the second substrate, respectively.

7 Claims, 5 Drawing Sheets

U.S. PATENT DOCUMENTS

| | | | | |
|---|---|---|---|---|
| RE37,444 | E | 11/2001 | Kanazawa | |
| 6,630,916 | B1 | 10/2003 | Shinoda | |
| 6,674,238 | B2 * | 1/2004 | Otani et al. | 313/587 |
| 6,707,436 | B2 | 3/2004 | Setoguchi et al. | |
| 6,806,645 | B2 * | 10/2004 | Choi | 313/582 |
| 6,873,106 | B2 * | 3/2005 | Amemiya et al. | 313/587 |
| 7,046,218 | B2 * | 5/2006 | Akiba | 345/60 |

FOREIGN PATENT DOCUMENTS

| | | |
|---|---|---|
| JP | 2917279 | 4/1999 |
| JP | 2001-043804 | 2/2001 |
| JP | 2001-325888 | 11/2001 |

* cited by examiner

PLASMA DISPLAY PANEL

CLAIM OF PRIORITY

This application makes reference to, incorporates the same herein, and claims all benefits accruing under 35 U.S.C. §119 from an application for PLASMA DISPLAY PANEL earlier filled in the Korean Intellectual Property Office on 8 Dec. 2004 and there duly assigned Serial No. 10-2004-0103131.

BACKGROUND OF THE INVENTION

1. Technical Field

The present invention relates to a plasma display panel, and more particularly, to a plasma display panel having a structure which increases a discharge space and a visible light emitting area, and enables low voltage driving, so as to increase brightness and improve light emission efficiency.

2. Description of the Related Art

Plasma display panels (PDPs) have received considerable attention as the next generation of flat display devices due to their superior characteristics, such as large screen size, high image quality, ultrathin and lightweight design, large viewing angle, simple manufacturing process, and suitability for a large screen size.

Plasma display panels (PDPs) can be classified into direct current (DC) PDPs, alternating current (AC) PDPs, and hybrid PDPs according to the discharge voltage applied. PDPs can further be classified into facing discharge PDPs and surface discharge PDPs according to their discharge structure. Recently, the alternating current type PDPs, having an alternating current type, three-electrode surface discharge structure, have been widely adopted.

A PDP typically includes a front panel and a rear panel. The front panel includes: a front substrate; a plurality of sustain electrode pairs, each having a Y electrode and an X electrode, formed on a lower surface of the front substrate; a front dielectric layer covering the sustain electrode pairs; and a protection film which covers the front dielectric layer. The X electrode and the Y electrode include transparent electrodes formed of indium tin oxide (ITO) and bus electrodes formed of a highly conductive metal, respectively.

The rear panel includes a rear substrate, a plurality of address electrodes crossing the sustain electrode pairs on a front surface of the rear substrate, a rear dielectric layer covering the address electrodes, a plurality of barrier ribs spaced at intervals on the rear dielectric layer so as to define discharge cells, a phosphor layer formed in each discharge cell, and a discharge gas which fills the discharge cells.

The PDP is formed by separately manufacturing the front panel and the rear panel, and then joining the two together and sealing them. The manufacturing of the PDP is completed by purging the discharge cells, and then injecting a discharge gas.

The alternating current type, three-electrode surface discharge PDP has a drawback in that only approximately 60% of visible light generated by the phosphor layer is emitted since a considerable amount of the visible light is absorbed by the dielectric layer covering the sustain electrode pairs on the lower surface of the front substrate, thereby providing a low light emission efficiency.

Also, the alternating current type, three-electrode surface discharge PDP has a problem of permanent latent images due to ion sputtering of charged discharge gas particles onto the phosphor layer after prolonged operation.

Finally, in the alternating current type, three-electrode surface discharge PDP, in order to enable low voltage driving by reducing address voltage, it is necessary to reduce the distance between the Y electrode, which is a common electrode, and the address electrodes. In this case, the discharge voltage may be reduced by reducing the height of the barrier ribs since this defines the distance between the electrodes. However, when the height of the barrier ribs is reduced, the area for coating phosphor is also reduced, thereby reducing the overall brightness of the panel.

SUMMARY OF THE INVENTION

The present invention provides a plasma display panel having a structure which increases a discharge space, increases a visible light emission area, and enables a low driving voltage to increase brightness and light emission efficiency.

According to an aspect of the present invention, a plasma display panel comprises: a pair of substrates including a first substrate and a second substrate facing each other; a barrier rib which is located between the first substrate and the second substrate, and which, together with the first and second substrates, defines discharge cells where gas discharge is generated; a plurality of discharge electrodes which comprise first discharge electrodes and second discharge electrodes which surround the discharge cell, which are vertically separated in the barrier rib, and which generate gas discharge by mutual action; and a first phosphor layer and a second phosphor layer located in the discharge cell formed in the first substrate and in the discharge cell formed in the second substrate, respectively.

The first discharge electrodes and the second discharge electrodes may be separated from each other, and may be electrically connected to each other along an end side of the first and second substrates.

The plasma display panel may further comprise address electrodes crossing the discharge cell, and extending so as to cross the first discharge electrodes and the second discharge electrodes which are electrically connected. In this case, the address electrodes may be located on the second substrate.

The inner surface of the barrier rib may be covered by a protection film. In this case, in the discharge cell, the phosphor layer is not located on a portion of the discharge cell corresponding to the barrier rib occupied by the first discharge electrode and the second discharge electrode, the first phosphor layer is located in the discharge cell corresponding to a portion of the barrier rib between the first discharge electrode and the first substrate, and the second phosphor layer is located in the discharge cell corresponding to a portion of the barrier rib between the second discharge electrode and the second substrate.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

The present invention will now be described more fully with reference to the accompanying drawings, in which exemplary embodiments of the invention are shown.

Figure 1:
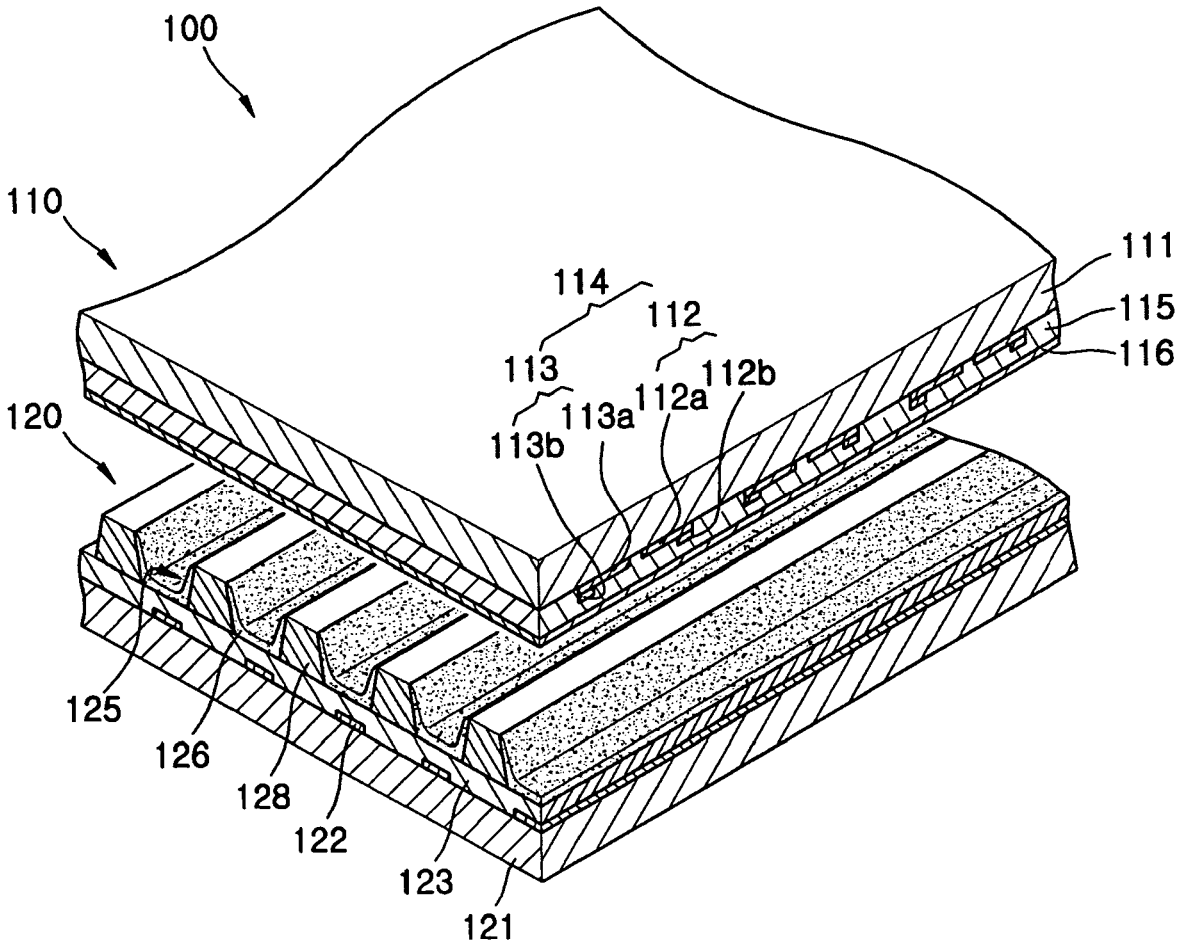
FIG. 1 is a partial perspective view of a plasma display panels (PDP)

FIG. 1 is a perspective view of a plasma display panels (PDP). More specifically, an alternating current type, three-electrode surface discharge PDP is shown.

The PDP 100 typically includes a front panel 110 and a rear panel 120. The front panel 110 includes a front substrate 111, a plurality of sustain electrode pairs 114 each having a Y electrode 112 and an X electrode 113 formed on a lower surface of the front substrate 111, a front dielectric layer 115 covering the sustain electrode pairs 114, and a protection film 116 which covers the front dielectric layer 115. The X electrode 113 and the Y electrode 112 include transparent electrodes 112*a* and 113*a*, respectively, formed of indium tin oxide (ITO) and bus electrodes 112*b* and 113*b*, respectively, formed of a highly conductive metal.

The rear panel 120 includes a rear substrate 121, a plurality of address electrodes 122 disposed on a front surface of the rear substrate 121 and crossing the sustain electrode pairs 114, a rear dielectric layer 123 covering the address electrodes 122, a plurality of barrier ribs 128 spaced at intervals on the rear dielectric layer 123 so as to define discharge cells 125, a phosphor layer 126 formed in each discharge cell 125, and a discharge gas (not shown) which fills the discharge cells 125.

The PDP 100 is formed by separately manufacturing the front panel 110 and the rear panel 120, and then joining the two together and sealing them. The manufacturing of the PDP 100 is completed by purging the discharge cells 125, and then injecting a discharge gas.

The alternating current type, three-electrode surface discharge PDP 100 has a drawback in that only approximately 60% of visible light generated by the phosphor layer 126 is emitted, since a considerable amount of the visible light is absorbed by the dielectric layer 115 covering the sustain electrode pairs 112 and 113 on the lower surface of the front substrate 111, thereby giving a low light emission efficiency.

In addition, the alternating current type, three-electrode surface discharge PDP 100 has the problem of permanent latent images due to ion sputtering of charged discharge gas particles onto the phosphor layer after prolonged operation.

Furthermore, in the alternating current type, three-electrode surface discharge PDP 100, in order to enable low voltage driving by reducing an address voltage, it is necessary to reduce the distance between the Y electrode 112, which is a common electrode, and the address electrodes 122. In this case, the discharge voltage is reduced by reducing the height of the barrier ribs 128 since this defines the distance between the electrodes 112 and 122. However, when the height of the barrier ribs 128 is reduced, the area for coating phosphor is also reduced, thereby reducing the overall brightness of the panel.

Figure 2:
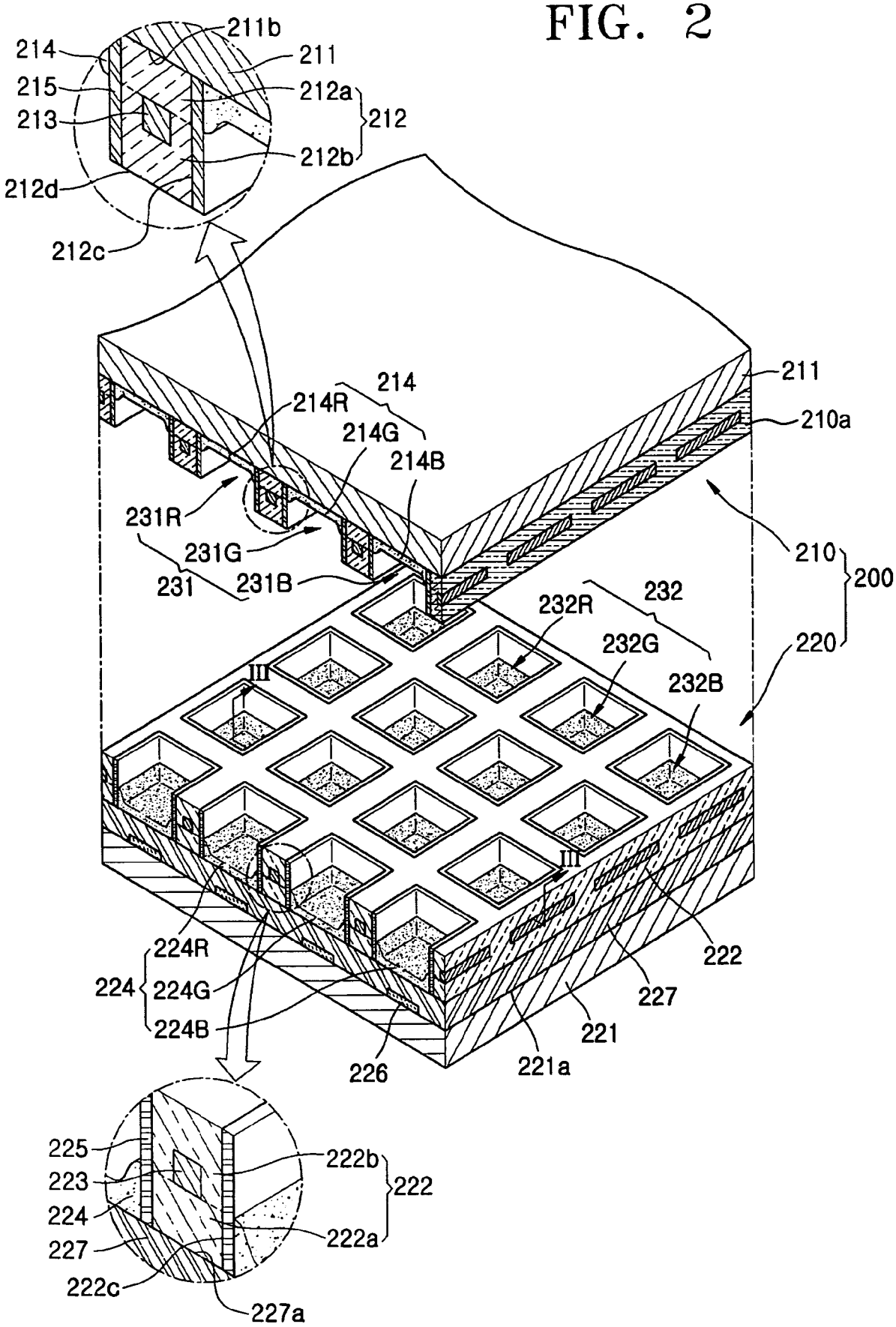
FIG. 2 is a partial perspective view of a PDP according to an embodiment of the present invention.
Figure 3:
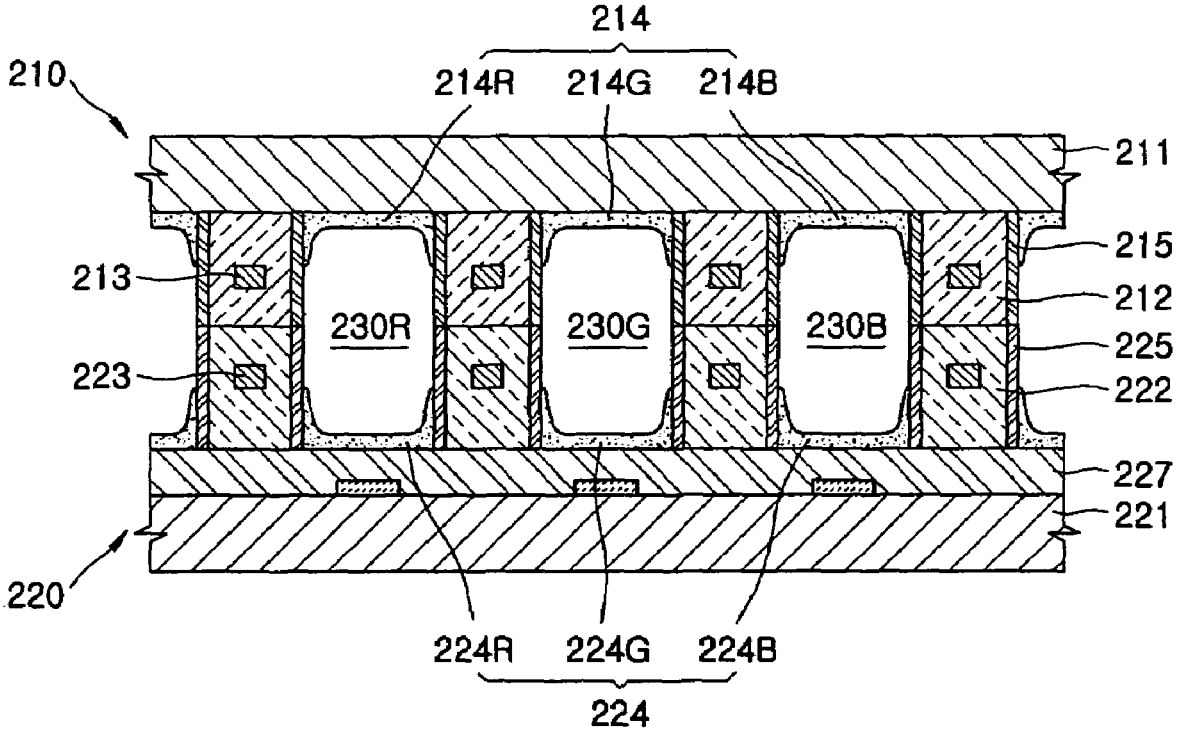
FIG. 3 is a cross-sectional view taken along line III—III of FIG. 2.
Figure 4:
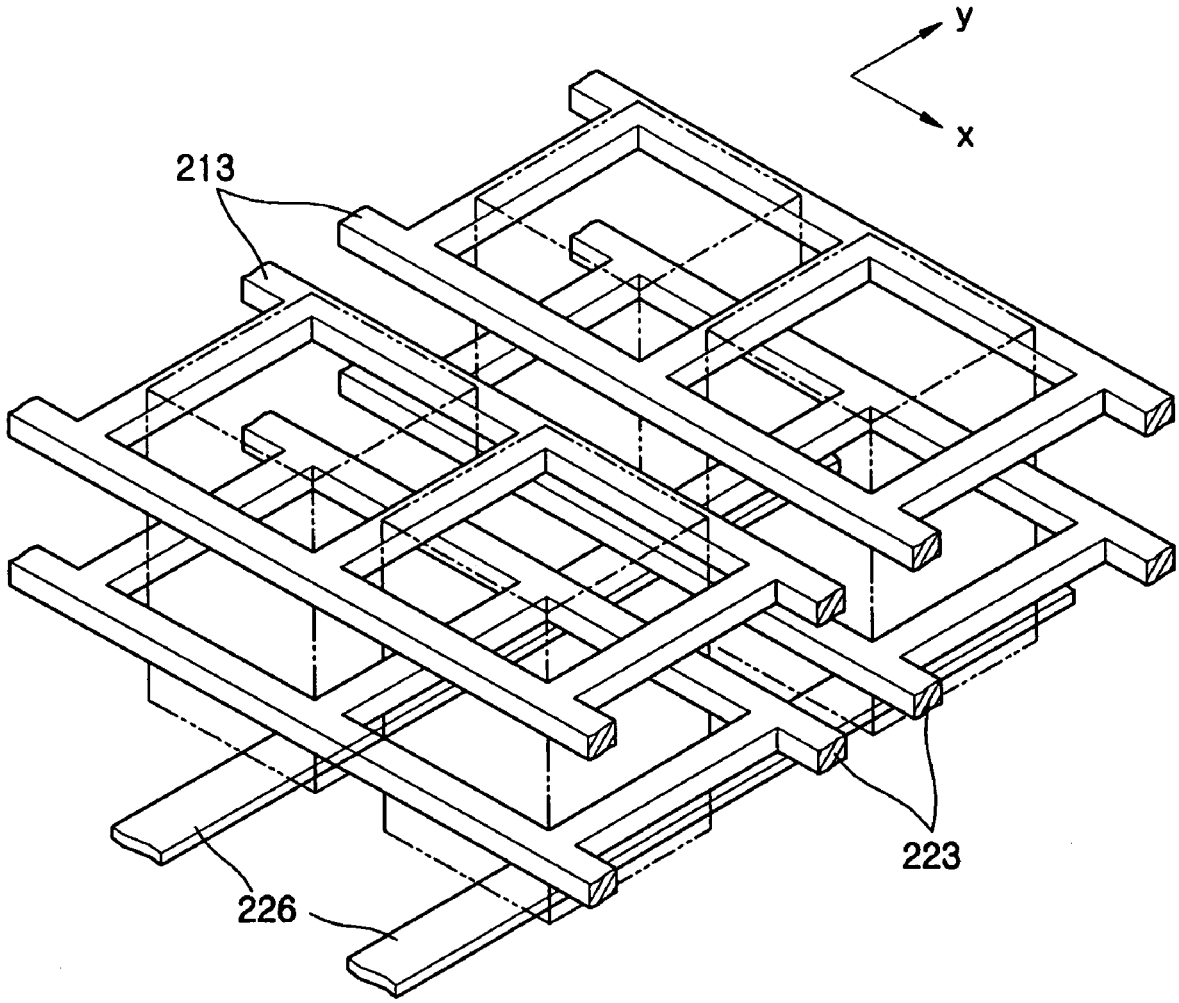
FIG. 4 is an exploded perspective view illustrating a first discharge electrode, a second discharge electrode, address electrodes, and discharge cells of a PDP according to an embodiment of the present invention.
Figure 5:
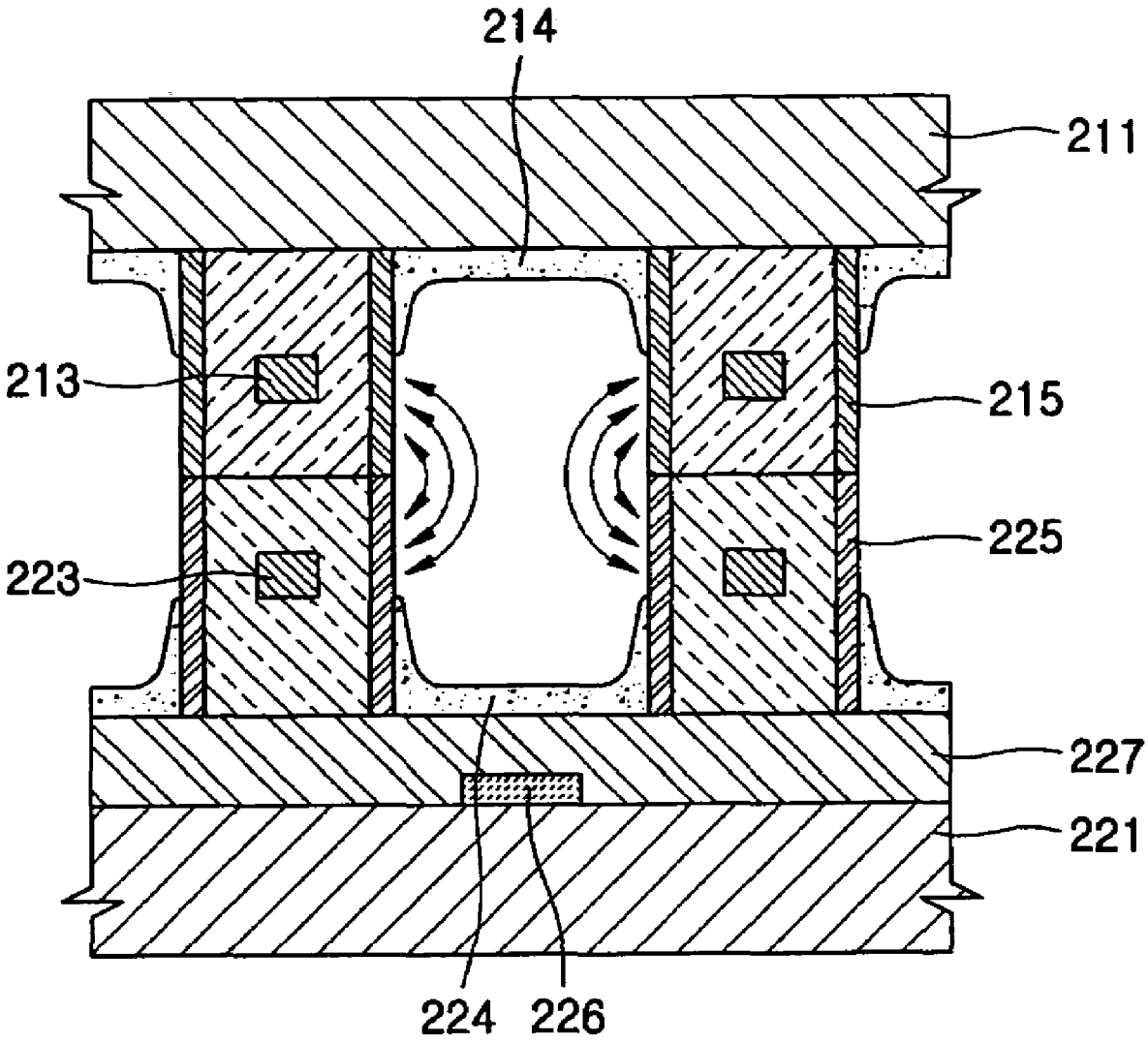
FIG. 5 is a cross-sectional view illustrating one discharge cell of a PDP according to an embodiment of the present invention.

FIG. 2 is a partial perspective view of a PDP according to an embodiment of the present invention, FIG. 3 is a cross-sectional view taken along line III—III of FIG. 2, FIG. 4 is an exploded perspective view illustrating a first discharge electrode, a second discharge electrode, address electrodes, and discharge cells of a PDP according to an embodiment of the present invention, and FIG. 5 is a cross-sectional view illustrating one discharge cell of a PDP according to an embodiment of the present invention.

Referring to FIGS. 2 and 3, a plasma display panel (PDP) 200 according to an embodiment of the present invention includes a first panel 210 and a second panel 220. The first panel 210 includes a transparent first substrate 211, and the second panel 220 includes a second substrate 221 parallel to and facing the first substrate 211.

A lower portion 210*a* of the first panel 210 is formed on the rear of the first substrate 211, more specifically, on the rear surface 211*b* of the first substrate 211, and includes a plurality of first barrier ribs 212 which define first discharge cells 231 (231R, 231G, 231B), which are front portions of discharge cells 230 (230R, 230G, 230B), together with the first substrate 211. Each discharge cell 230 includes a first discharge cell 231 which is a front portion of the discharge cell 230 and a second discharge cell 232 which will be described later, and the first discharge cell 231 and the second discharge cell 232 constitute one unit discharge cell 230. Also, the first panel 210 includes: a plurality of first discharge electrodes 213 disposed in the first barrier ribs 212 so as to surround the first discharge cell 231 and separated from the first substrate 211; a first protection film 215 which covers at least one lateral surface 212*c* of the first barrier ribs 212; and first phosphor layers 214R, 214G and 214B comprising red, green, and blue phosphors, respectively, corresponding to inner spaces of the first discharge cells 231R, 231G and 231B, respectively, defined by the first barrier ribs 212 and the first substrate 211.

The second panel 220 includes: the second substrate 221; a plurality of address electrodes 226 located on the front surface of the second substrate 221 and extending so as to cross the first discharge electrodes 213; a dielectric layer 227 covering the address electrodes 226; a plurality of second barrier ribs 222 which are formed on the dielectric layer 227 and which define second discharge cells 232, which are rear portions of the discharge cells 230, together with the second substrate 221; a plurality of second discharge electrodes 223 located in the second barrier ribs 222 surrounding the second discharge cells 232; a second protection film 225 covering at least one lateral surface 222*c* of the second barrier ribs 222; and second phosphor layers 224R, 224G and 224B comprising red, green, and blue phosphors, respectively, corresponding to inner spaces of the second discharge cells 232R, 232G, and 232B, respectively, defined by the second barrier ribs 222 and the second substrate 221.

The first panel 210 and the second panel 220 are coupled and sealed by a coupling member, such as a frit (not shown), and the unit discharge cells 230 are filled with a discharge gas selected from Ne gas, He gas, Ar gas, and Xe gas, or a gas mixture of at least two of these gases.

In general, the first substrate 211 and the second substrate 221 are formed of glass, and may be formed of a material having a high light transmittance. While, in the previously discussed PDP 100 of FIG. 1, the sustain electrode pairs 114, the front dielectric layer 115 covering the sustain electrode pairs 114, and the protection film 116 are located on the rear surface of the front substrate 111, in the PDP 200 of FIG. 2, these elements are not located on a portion of the rear surface 211*b* of the first substrate 211 which defines the first discharge cell 231.

In addition, in order to increase the brightness of the PDP 200, a reflection layer (not shown) can be located on the upper surface 221*a* of the second substrate 221 or on the upper surface 227*a* of the dielectric layer 227, or visible light generated by the phosphor layers 214 and 224 can be effectively reflected forward by including a light reflecting material in the dielectric layer 227.

Accordingly, unlike the alternating current type, three-electrode surface discharge PDP, in the present invention, visible light generated by the phosphor layers 214 and 224 of the discharge cells 231 and 232 passes through the transparent first substrate 211 having high light transmittance without absorption, thereby greatly increasing the forward light transmittance.

Also, in the alternating current type, three-electrode surface discharge PDP, the sustain electrode pairs 114 disposed on a rear surface of the first substrate 111 are formed of a transparent material, such as ITO, in order to retain light transmittance. However, the ITO electrode has a large resistance and causes a voltage drop in the lengthwise direction of the sustain electrode pairs 114. To solve this problem, a complicated structure, for example a narrow bus electrode formed of a conductive metal, could be additionally employed. However, in the PDP 200 according to the present invention, no additional element, such as an electrode that can absorb visible light, is located on the first discharge cell 231 through which the visible light passes. Therefore, in order to form discharge electrodes 213 and 223, a material having high conductivity can be selected without considering the light transmittance of the material. The discharge electrodes 213 and 223 may be formed of a material having high conductivity, such as Ag, Cu, and Cr.

The configuration of the first discharge electrode 213, the second discharge electrode 223, and the address electrodes 226 will now be described with reference to FIG. 4. The first discharge electrode 213 and the second discharge electrode 223 have a trapezoidal shape, and extend in parallel with an x axis direction, and the address electrodes 226 extend in a y axis direction so as to cross the first discharge electrode 213 and the second discharge electrode 223. In FIG. 4, hexahedral elements drawn with a dashed line indicate unit discharge cells 230. As depicted in FIG. 4, since the distance between the second discharge electrode 223 and the address electrode 226 is short, an address discharge for selecting a discharge cell is preferably generated between the second discharge electrode 223 and the address electrode 226. In this case, the second discharge electrode 223 functions as a common electrode and a sustain electrode, and the first discharge electrode 213 functions as a scanning electrode and a sustain electrode, but the present invention is not limited thereto.

The first barrier ribs 212 (FIGS. 2 and 3) are formed to define the first discharge cells 231 together with the first substrate 211. Referring to FIG. 2, the first barrier ribs 212 define the first discharge cells 231 in a matrix, but the present invention is not limited thereto, and the first discharge cells 231 can be defined in various shapes, such as a honeycomb or delta shape. Also, in FIG. 3, the horizontal cross-section of the discharge cells 230 is depicted as rectangular, but the present invention is not limited thereto, and the cross section may be a polygon, such as a triangle or a pentagon, or a circle or an oval.

The first discharge electrodes 213 surround the first discharge cell 231 in the first barrier rib 212. In order to form the first discharge electrode 213 in the first barrier ribs 212, as depicted in the enlargement in FIG. 2, a first barrier layer 212*a* of the first barrier rib 212 is formed on the rear surface 211*b* of the first substrate 211, and the first discharge electrode 213 is formed on the first barrier layer 212*a*. Subsequently, a second barrier layer 212*b* of the first barrier rib 212 covering the first discharge electrode 213 is formed on the first discharge electrode 213. The first barrier layer 212*a* and the second barrier layer 212*b* can be formed of glass containing an element such as Pb, B, Si, Al, and O, and if necessary, can be formed of a dielectric containing a filler, such as $ZrO_2$, $TiO_2$, or $Al_2O_3$, and a pigment, such as Cr, Cu, Co, Fe, or $TiO_2$. When a pulse voltage is applied to the first discharge electrode 213, the dielectric induces wall charge by inducing charged particles, and protects the first discharge electrode 213.

After the first barrier rib 212 is formed, a first protection film 215 may be formed at least on the lateral surface 212*c* of the first barrier rib 212 using a deposition method. The first protection film 215 protects the first discharge electrode 213 during discharge, and encourages discharge by emitting secondary electrons. Also, a protection film can be formed on the rear surface 211*b* of the first substrate 211, and on the lateral surface 212*c* of the first barrier rib 212. However, the protection films formed on the rear surface 211*b* of the first substrate 211 and on the lateral surface 212*c* of the first barrier rib 212 do not affect the present invention.

A first phosphor layer 214 can be coated on an inner side of the first discharge cell 231 defined by the first barrier rib 212 and the first substrate 211, more specifically, on at least the lateral surface of the first barrier rib 212 and on the rear surface 211*b* of the first substrate 211 exposed by the first barrier ribs 212. The first phosphor layer 214 includes first phosphor layers 214R, 214G and 214B comprising red, green, and blue phosphors, respectively, for displaying a color image. The first phosphor layers 214R, 214G and 214B are located in the discharge cells 231R, 231G and 231B, respectively, which constitute a unit pixel for displaying the color image. The first phosphor layer 214 can be at the same level as the first barrier rib 212, but is preferably at a lower level than the first barrier rib 212, that is, at a lower level than the rear surface 212*d* of the first barrier rib 212. The first phosphor layer 214 can be directly located at least on a lateral surface of the first barrier rib 212 at the same level as the first barrier rib 212 without forming the first protection film 215 at least on the lateral surface of the first barrier rib 212. However, in this case, the first phosphor layer 214 may be degraded by ion sputtering of charged particles. Therefore, it is desirable that the first phosphor layer 214 be at a lower level than the first barrier rib 212.

The first phosphor layer 214 can be formed by coating a paste made of a mixture of a red, green or blue phosphor, a solvent, and a binder onto the rear surface 211*b* of the first substrate 211 and on at least the lateral surface 212*c* of the first barrier rib 212, and then drying and annealing the paste. The red phosphor of the first phosphor layer 214 can include $Y(V,P)O_4$:Eu, the green phosphor can include $Zn_2SiO_4$:Mn, and the blue phosphor can include BAM:Eu.

The second barrier rib 222 is formed on the dielectric layer 227 so as to define the second discharge cells 232 together with the second substrate 221. The second barrier rib 222 defines the second discharge cells 232 in the same manner as the first barrier rib 212, and thus the description thereof will not be repeated. The second discharge electrode 223 surrounding the second discharge cells 232 is formed in the second barrier rib 222. To form the second discharge electrode 223 in the second barrier rib 222, as depicted in the enlargement in FIG. 2, a first barrier rib layer 222*a* of the second barrier rib 222 is formed on the upper surface 227*a* of the dielectric layer 227, and the second discharge electrode 223 is formed on the first barrier rib layer 222*a*. Afterward, a second barrier rib layer 222*b* of the second barrier rib 222 covering the second discharge electrode 223 is formed on the second discharge electrode 223. The second barrier rib 222, like the first barrier rib 212, can also be formed of glass containing an element such as Pb, B, Si, Al, and O, and if necessary, can be formed of a dielectric layer containing a filler, such as $ZrO_2$, $TiO_2$, or $Al_2O_3$, or a pigment, such as Cr, Cu, Co, Fe, or $TiO_2$. When a pulse voltage is applied to the second discharge electrode 223, the dielectric induces wall charge by inducing charged particles, and protects the second discharge electrode 223.

A first phosphor layer 224 can be coated on an inner side of the second discharge cell 232 defined by the second barrier rib 222 and the second substrate 221, more specifically, on at least the lateral surface of the second barrier rib 222 and on the front surface of the dielectric layer exposed by the second barrier rib 222. The second phosphor layer 224 includes second phosphor layers 224R, 224G and 224B comprising red, green and blue phosphors, respectively, for displaying a color image. The second phosphor layers 224R, 224G and 224B correspond to the first phosphor layers 214R, 214G and 214B, respectively. The configuration of the second phosphor layer 224 is identical to that of the first phosphor layer 214, and thus, the description thereof will not be repeated.

The discharge operation of the PDP 200 according to an embodiment of the present invention will now be described.

When an address voltage is applied between the address electrode 226 and the second discharge electrode 223 from an external power source, wall charge is accumulated in the selected discharge cell 230 along the second discharge electrode 223, more specifically, on a lateral surface of the second barrier rib 222 in a ring shape, since the second discharge electrode 223 surrounds a lower part of the discharge cell 230.

Next, when a positive voltage is applied to the first discharge electrode 213 and a voltage lower than the positive voltage is applied to the second discharge electrode 223, the wall charge migrates due to the voltage difference between the first discharge electrode 213 and the second discharge electrode 223. When the wall charge migrates, it collides with atoms of the discharge gas in the discharge cell 230, generating discharge and producing plasma. In this case, strong electric fields are formed at portions where the first discharge electrode 213 and the second discharge electrode 223 are close to each other. Therefore, there is a high possibility of commencing discharge at these portions.

In the case of the present embodiment, as depicted in FIG. 5, the close portions between the first discharge electrode 213 and the second discharge electrode 223 are formed in a ring shape along the inner surface of the discharge cell 230. Therefore, the possibility of generating discharge is greatly increased due to the increased discharge region, compared to the alternating current type, three-electrode surface discharge PDP 100 of FIG. 1, in which the close portion between the discharge electrodes is only formed on the upper part of the discharge cell.

When the voltage between the first discharge electrode 213 and the second discharge electrode 223 is maintained for a predetermined time, the electric fields formed on the four sidewalls of the discharge cell 230 are gradually concentrated in the center of the discharge cell 230, and thus the discharge is diffused into the entire region of the discharge cell 230. In the alternating current type, three-electrode surface discharge PDP 100 of FIG. 1, the discharge is generated at the upper part of the discharge cell and diffuses into the central part of the discharge cell. However, the discharge in the discharge cell 230 of the present invention has a greatly increased diffusion range compared to the discharge of prior arrangements since the discharge in the discharge cell 230 is formed in a ring shape at the four sidewalls of the discharge cell 230, and diffuses into the central part of the discharge cell 230. Accordingly, more plasma is generated by the discharge, and more ultraviolet rays are generated by the plasma, thereby increasing the brightness of the PDP 200. In addition, the power efficiency can be increased since less power is required for the same brightness. Also, since the plasma produced by the discharge of the present invention is diffused into the central part of the discharge cell 230 after the plasma is formed in a ring shape along the sidewalls of the discharge cell 230, the volume of the plasma is greatly increased, which increases the amount of visible light. Furthermore, since the plasma is concentrated in the central part of a discharge space 220, space charge can be utilized, thereby enabling low voltage driving and improving light emission efficiency. Also, since the plasma is concentrated on the central part of the discharge cell 230, and electric fields generated by the discharge electrodes 213 and 223 are formed on both sides of the plasma, the charge is concentrated in the central part of the discharge cell 230. Therefore, ion sputtering of charge to the phosphor layers 214 and 224 can be prevented.

After the above discharge, when the voltage difference between the first discharge electrode 213 and the second discharge electrode 223 becomes smaller than the discharge voltage, the discharge stops, and space charge and wall charge are formed in the discharge cell 230. At this time, when voltages which have opposite polarities to and smaller levels than the voltages applied to the first discharge electrode 213 and the second discharge electrode 223 are applied to the first discharge electrode 213 and the second discharge electrode 223, respectively, and reach the breakdown voltage with the aid of the wall charge, discharge resumes. If the polarities of the voltages applied to the first discharge electrode 213 and the second discharge electrode 223 are reversed again, the initial discharge process is repeated. Accordingly, discharge is reliably maintained through the repetitive discharge processes.

However, the discharge process according to the present invention is not limited to that described, and various discharge processes which can be understood by those skilled in the art can apply.

Also, in the address discharge for selecting the discharge cell 230, a low voltage for addressing is advantageous. To reduce the voltage, it is important to reduce the distance between the address electrode and the common electrode. In FIG. 1, the distance between the address electrode 122 and the Y electrode 113 is determined by the height of the barrier rib 128. However, reducing the height of the barrier rib 128 to improve the address discharge characteristics also reduces the phosphor coating area, thereby reducing the light emission efficiency. However, in the present embodiment, the distance between the address electrode 226 and the second discharge electrode 223 can be reduced without reducing the height of the barrier rib, since the second discharge electrode 223 which functions as sustain and common electrodes is located in the second barrier rib 222, thereby enabling a low voltage driving and high speed driving of the PDP 200.

Also, short circuits between the electrodes 213 and 223 can be prevented since the first discharge electrode 213 is located in the first barrier rib 212 and the second discharge electrode 223 is located in the second barrier rib 222.

Furthermore, according to the embodiment of the present invention, the first phosphor layers 214R, 214G and 214B are located in the front portions 231 of the light emitting cells defined by the first barrier rib 212 and the rear surface 211*b* of the first substrate 211 exposed by the first barrier rib 212, and the second phosphor layers 224R, 224G and 224B are located in the rear portions 232 of the light emitting cells defined by the second barrier rib 222 and the front surface 227*a* of the dielectric layer exposed by the second barrier rib 222. The PDP 200 according to the present invention employs a structure in which the phosphor layer extends to the first panel. Thus, far more visible light is generated by the phosphor layers 214 and 224 than by prior arrangements. Accordingly, the brightness and light emission efficiency of the PDP 200 are greatly improved.

The present invention is not limited to the structure in which the first discharge electrode 213 is located in the first barrier rib 212 and the second discharge electrode 223 is located in the second barrier rib 222. That is, the first barrier rib 212 and the second barrier rib 222 form one barrier rib when the first panel 210 and the second panel 220 are assembled. In an assembled state, the first discharge electrode 213 and the second discharge electrode 223 can be located in the same barrier rib since the first barrier rib 212 and the second barrier rib 222 eventually become the same barrier rib.

In the PDP 200 according to the embodiment of the present invention, the address electrodes 226 are included in order to generate address discharge, but a PDP having the structural aspect of the PDP 200 according to the embodiment of the present invention can be realized without the address electrodes 226. In this case, the first discharge electrode 213 and the second discharge electrode 223 function as the address electrodes 226, and the dielectric layer covering the address electrodes 226 is unnecessary since the address electrodes 226 are not included.

The PDP which does not have address electrodes will now be briefly described. A structure which does not include address electrodes employs a first discharge electrode located in a first barrier rib so as to surround a first discharge cell and extending in one direction, and a second discharge electrode located in the second barrier rib so as to surround a second discharge cell and extending so as to cross the first discharge electrode. In this case, an address discharge is generated by applying a predetermined voltage to the first discharge electrode and the second discharge electrode located as to cross each other in the discharge cell, and wall charge is generated in a ring shape along the inner surface of the discharge cell. Afterward, as described above relative to the embodiment of the present invention, sustain discharge is generated by a voltage alternately applied to the first discharge electrode and the second discharge electrode, and with the aid of the wall charge. Through these processes, which are specifically and repeatedly induced in discharge cells of the PDP panel, a predetermined image can be implemented.

The PDP which does not have address electrodes can have a simple internal structure. Also, if the barrier ribs are in the form of a matrix in which the horizontal cross-section of the discharge cells is square, a complete PDP can be obtained by preparing two panels having the same structure, rotating one of the panels by 90 degrees, and joining the two panels. In this case, separate manufacture of the two panels is unnecessary, thereby reducing the manufacturing cost of the PDP.

The PDP according to the present invention employs a structure in which the first discharge electrodes are located in the first barrier rib so as to surround the first discharge cell, and the second discharge electrodes are located in the second barrier rib so as to surround the rear portion of the discharge cell, and the phosphor layer is located in the first panel, unlike in a PDP in which the sustain electrode pairs are formed in a first panel and the phosphor layer which generates visible light is located in a second panel. Due to this structural aspect of the PDP according to the present invention, the area for generating visible light is increased, since the phosphor coating area is increased, and the brightness of the PDP is greatly increased since the amount of the visible light is increased. Also, the light transmittance of the PDP is greatly improved, since electrodes, a dielectric layer, and a protection layer, which absorb visible light, are unnecessary in the first panel of the PDP, and accordingly, the visible light generated by the phosphor layers in the discharge cells can pass directly through the first substrate.

Also, in the present invention, the first discharge electrode and the second discharge electrode can be formed of a material having a high conductivity, since the discharge electrodes do not need to be transparent. Therefore, even a PDP having a large screen will not suffer from a voltage drop in the discharge electrodes, which would cause an uneven image.

In the prior PDPs, the light emission efficiency is low since the discharge is generated on the rear of a protection film and diffuses into the discharge cell, and there is a problem of permanent latent images after prolonged operation, due to ion sputtering of charged particles of a discharge gas onto the phosphor layer. However, in the present invention, these problems can be solved since the discharge is generated on all sidewalls of the discharge cell, and then concentrates in the central part of the discharge cell.

Also, in the present invention, the discharge is generated on all sidewalls of the discharge cell, and concentrates in the central part of the discharge cell, since the first discharge electrode and the second discharge electrode surround the discharge cell in the first barrier rib and the second barrier rib, thereby using the discharge space effectively. Accordingly, the brightness of the PDP is increased as a result of increasing the discharges. Also, the overall power efficiency can be increased since a lower power is required at the same brightness.

While the present invention has been particularly shown and described with reference to exemplary embodiments thereof, it will be understood by those of ordinary skill in the art that various changes in form and detail may be made therein without departing from the spirit and scope of the present invention as defined by the following claims.

What is claimed is:

1. A plasma display panel, comprising:

a pair of substrates including a first substrate and a second substrate facing each other;

a barrier rib which is located between the first substrate and the second substrate, and which, together with the first and second substrates, defines discharge cells where gas discharge is generated;

a plurality of discharge electrodes, including first discharge electrodes and second discharge electrodes which surround the discharge cells, and which are vertically separated in the barrier rib, for generating a gas discharge by mutual actions; and a first phosphor layer and a second phosphor layer located in the discharge cell formed in the first substrate and in the discharge cell formed in the second substrate, respectively.

2. The plasma display panel of claim 1, wherein the first discharge electrodes and the second discharge electrodes are separated from each other, and are electrically connected to each other along an end side of the first and second substrates.

3. The plasma display panel of claim 2, further comprising address electrodes crossing the discharge cells, and extending so as to cross the first discharge electrodes and the second discharge electrodes which are electrically connected.

4. The plasma display panel of claim 3, wherein the address electrodes are located on the second substrate.

5. The plasma display panel of claim 1, further comprising a protection film covering an inner surface of the barrier rib.

6. The plasma display panel of claim 5, wherein, in the discharge cell, the first and second phosphor layers are not located in an area other than a portion of the discharge cell corresponding to the barrier rib occupied by the first discharge electrode and the second discharge electrode.

7. The plasma display panel of claim 6, wherein the first phosphor layer is located in a discharge cell corresponding to a portion of the barrier rib between the first discharge electrode and the first substrate, and the second phosphor layer is located in a discharge cell corresponding to a portion of the barrier rib between the second discharge electrode and the second substrate.

* * * * *